US007487832B2

(12) United States Patent
Read, Jr.

(10) Patent No.: US 7,487,832 B2
(45) Date of Patent: Feb. 10, 2009

(54) FORCE TRANSFER APPARATUS TO ASSIST RELEASE OF LOADED MEMBER

(75) Inventor: Dennis M. Read, Jr., Manvel, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 465 days.

(21) Appl. No.: 10/907,660

(22) Filed: Apr. 11, 2005

(65) Prior Publication Data

US 2005/0224226 A1 Oct. 13, 2005

Related U.S. Application Data

(60) Provisional application No. 60/521,364, filed on Apr. 9, 2004.

(51) Int. Cl.
*E21B 29/00* (2006.01)
*E21B 23/06* (2006.01)

(52) U.S. Cl. ..... 166/297; 166/55; 166/55.1; 166/123

(58) Field of Classification Search ..... 166/55, 166/55.1, 123, 125, 297
See application file for complete search history.

(56) References Cited

U.S. PATENT DOCUMENTS

| | | | |
|---|---|---|---|
| 4,253,521 | A | 3/1981 | Savage |
| 4,385,664 | A | 5/1983 | Hutchison |
| 4,832,129 | A | 5/1989 | Sproul |
| 5,046,557 | A | 9/1991 | Manderscheid |
| 5,314,014 | A | 5/1994 | Tucker |
| 5,687,795 | A | 11/1997 | Patel et al. |
| 6,481,496 | B1 | 11/2002 | Jackson et al. |
| 6,651,750 | B2 | 11/2003 | Whitsitt |

FOREIGN PATENT DOCUMENTS

| | | | |
|---|---|---|---|
| GB | 2372767 | A | 4/2002 |

*Primary Examiner*—Shane Bomar
(74) *Attorney, Agent, or Firm*—Trop, Pruner & Hu, P.C.; Jeremy P. Welch; James L. Kurka

(57) ABSTRACT

A completion assembly having a force transfer apparatus to assist in the release of a loaded member.

20 Claims, 11 Drawing Sheets

FORCE TRANSFER APPARATUS TO ASSIST RELEASE OF LOADED MEMBER

This application claims the benefit of U.S. Provisional Application 60/521,364 filed on Apr. 9, 2004.

BACKGROUND

1. Field of Invention

The present invention pertains to a releasable downhole completion assembly having a loaded member, and particularly to a releasable downhole completion assembly having a force transfer apparatus to assist in the release of the loads in the loaded member.

2. Related Art

Completions are placed in a well to assist in the production of fluids from the well. Some completions are permanent while others are placed temporarily to perform certain operations within the well. Temporary completions are typically releasably fixed to the casing or wellbore wall and the one or more operations are conducted. After all such operations are completed, the release mechanism is actuated and the temporary completion is removed.

However, a release mechanism sometimes fails to release because unanticipated loads in the structural elements overcome or counteract the release actuation mechanism. For example, a releasable packer anchoring the completion with slips engaging the casing may rely on an upward pull of the tool string to actuate the release. However, compressive loading from below may prevent the relative motion between structural elements required to allow the slips to disengage from the casing. Such a situation leads to considerable delay and extra expense.

SUMMARY

The present invention provides for a completion assembly having a force transfer apparatus to assist in the release of a loaded member.

Advantages and other features of the invention will become apparent from the following description, drawings, and claims.

DETAILED DESCRIPTION

Figure 1:
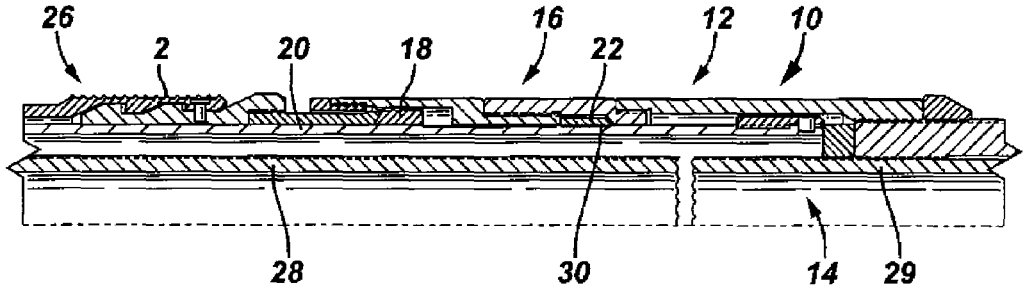
FIG. 1 shows a schematic view of a force transfer apparatus constructed in accordance with the present invention, with the apparatus shown in an initial configuration.
Figure 2:
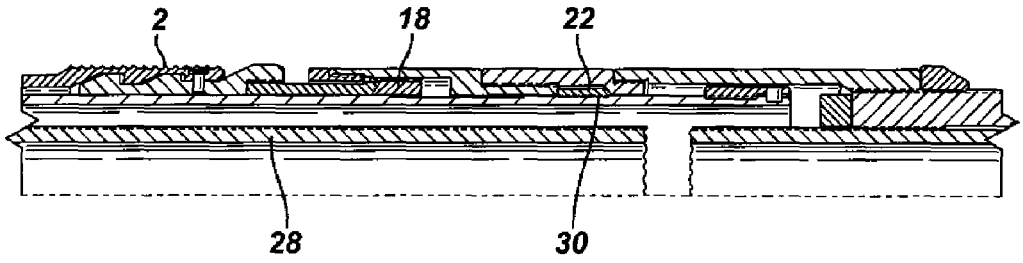
FIG. 2 shows a schematic view of the force transfer apparatus of FIG. 1 in an intermediate configuration.
Figure 3:
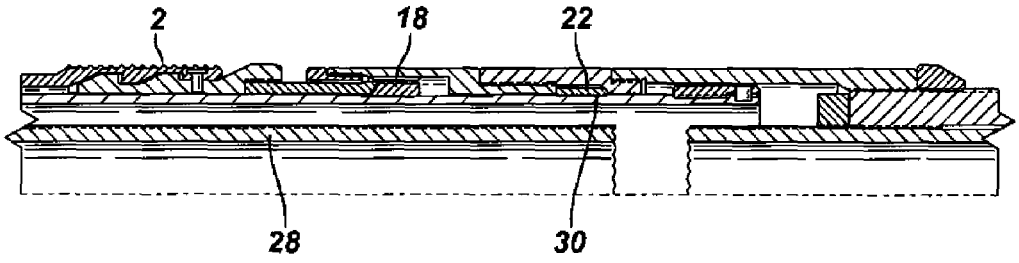
FIG. 3 shows a schematic view of the force transfer apparatus of FIG. 1 in a final configuration.

In the embodiments shown, a packer is illustrated, but the invention is not limited in application solely to packers. Referring to FIGS. 1, 2, and 3, a force transfer apparatus 10 comprises a lower housing assembly 12, an inner mandrel assembly 14, a slip joint 16, a load transfer device 18, a middle mandrel 20, a transfer ratchet 22, and a cone and slip assembly 26. Transfer ratchet 22 and load transfer device 18 can be a ring, dog, collet, or other such mechanism.

To release certain packers, the inner mandrel assembly 14 is often severed. The severing can be accomplished in various ways such as through hydraulic action, by shifting of elements, or by cutting, as is well known in the art. A packer that releases upon the cutting of inner mandrel assembly 14 is commonly known as a "cut-to-release" packer. Once inner mandrel assembly 14 is cut, the severed members allow the upper part of the packer, which is secured to middle mandrel 20, to travel upward. Middle mandrel 20 releases load transfer device 18 and energy is lost between the lower end of inner mandrel assembly 14 and cone and slip assembly 26 by breaking the load path through lower housing 12. To prevent the possible upward movement of the lower end of inner mandrel assembly 14 and lower housing 12 from re-engaging cone and slip assembly 26, transfer ratchet 22 changes the compressive load path from the lower end of inner mandrel 14 through the lower part of the lower housing assembly 12 to middle mandrel 20. This effectively bypasses slip joint 16. Further upward movement will put cone and slip assembly 26 in tension to aid in its release.

Figure 7:
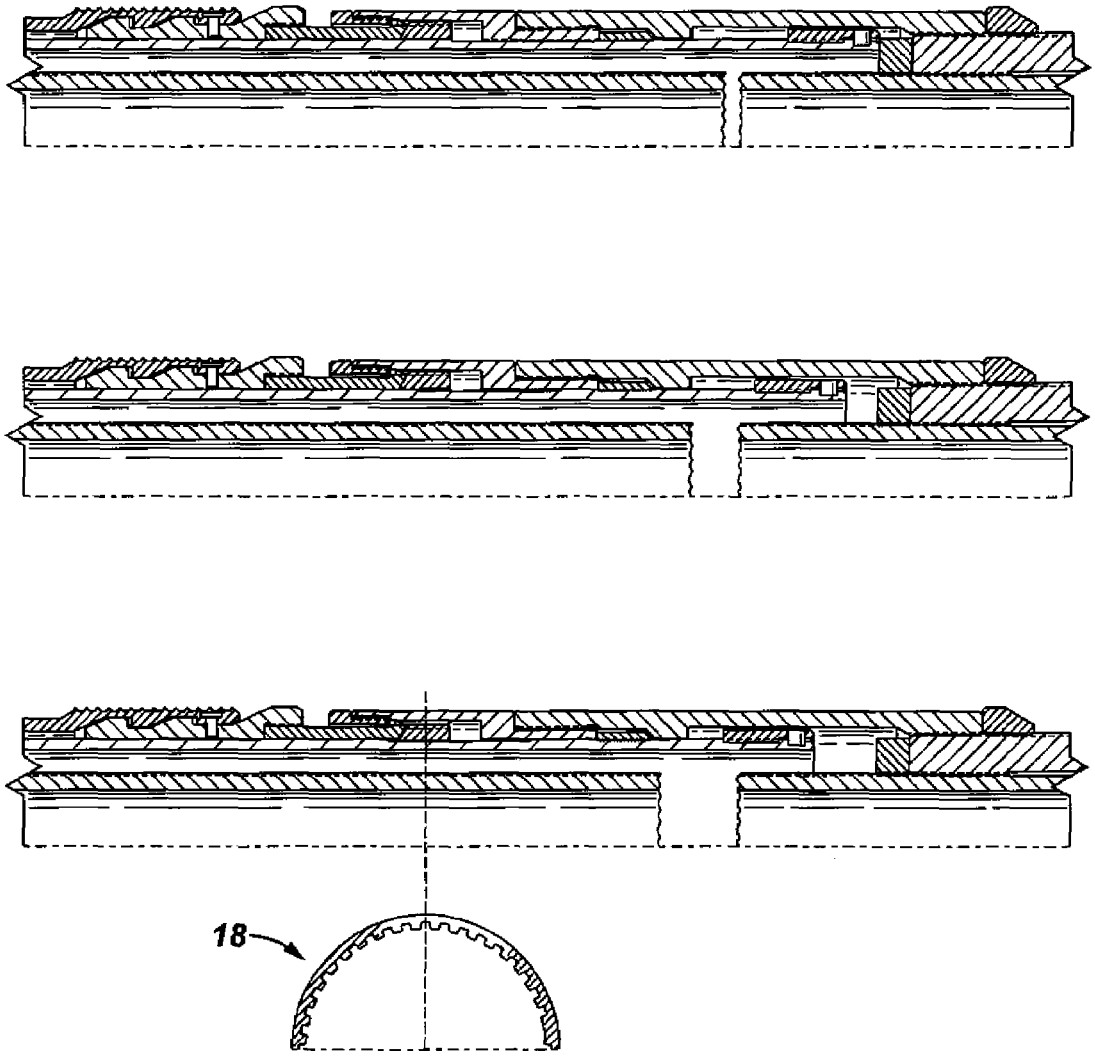
FIG. 7 shows a schematic view of one embodiment of a load transfer device used in the force transfer apparatus of FIG. 1.

FIGS. 1-3 show a first embodiment in the set, mid-release, and released positions in a cut-to-release packer. Inner mandrel assembly 14 can be divided into an upper inner mandrel 28 and lower inner mandrel 29 by shifting sleeves, shear release devices, or other standard methods as mentioned above. The lower end (right-hand side) of FIG. 7 shows a cross-sectional representation of a split ring with threads on the inner and outer diameters relieved to decrease stiffness while maintaining roundness and bearing load area. The relief pattern is not shown as optimized for the ring, but could be optimized by varying the hole spacing.

In a packer, slips anchor the completion to the casing or wellbore wall to prevent upward and downward movement. Inner mandrel assembly 14 normally transfers the load created from upward movement from below through the outer housing 12, into the lower cone and slip assembly 2, wedging the slip into the casing. As long as there is compression from below, the slip remains engaged and prevents upward movement of the system. After inner mandrel assembly 14 is cut, the upper inner mandrel 28 is put in tension and movement begins. The upward movement of upper inner mandrel 28 releases load transfer device 18 and essentially creates a gap within lower housing assembly 12. This gap can be created anywhere within lower housing assembly 12 between the lower cone and slip assembly 26 and lower inner mandrel 29, preferably in a location that provides the ideal load scenario to carry the completion and allow clearance for the load transfer device 18 (or equivalent) packaging and release.

The gap created allows lower inner mandrel 29 and the lower part of lower housing 12 to move upward without engaging cone and slip assembly 26. The slip joint 16 allows this movement. As such movement occurs, transfer ratchet 22 is moved by lower housing 12 and engages threads 30 in middle mandrel 20 to limit movement toward reengaging cone and slip assembly 26. It also transfers the compressive load from the upper part of lower inner mandrel 29 through middle mandrel 20 to assist in the release of the packer by applying force directly at the packer in the upward direction. Continued upward movement of the upper inner mandrel 28 engages the cone and slip assembly 26. Slip joint 16 then engages the lower part of lower housing 12, putting cone and slip assembly 26 in tension relative to lower inner mandrel 29, by way of a retaining nut. This is the ideal release mode for the cone and slip assembly 26. The strokes of the system can be tuned to either carry the load through cone and slip assembly 26, or ideally through middle mandrel 20 to the lower part of lower housing 12, and to lower inner mandrel 29. At some point in its upward travel, middle mandrel 20 engages the lower part of lower housing 12 that carries lower inner mandrel 29 and the remaining portion of the completion.

The load transfer device 18 can be embodied using various mechanical methods (dog, collet, ratchet, segmented ring, conventional snap ring, shear device, or any such load-bearing device). However, it may be optimized for bearing and deflection by creating a series of load shoulders to minimize required deflection to disengage a housing, while maximizing load transfer. This is not dissimilar from standard ratchets. However, in the present invention, the ratchet can be released radially. To maximize thread engagement, the thick ring can be segmented by relief of the inner diameter or outer diameter. One method could be to drill holes at either regular or irregular intervals, as shown in FIG. 7. As C-Rings deflect non-uniformly, the holes can be spaced such that, with a constant cross-sectional height, the deflecting ring can remain round while it is distorted. More holes can be drilled in the more rigid sections, while the center of the ring can remain stiffer and act less like a hinge point. The surface area of the ring can be increased without increasing the stiffness of the ring. The use of a ring, as opposed to a collet, maximizes load capacity and bearing areas.

Figure 4:
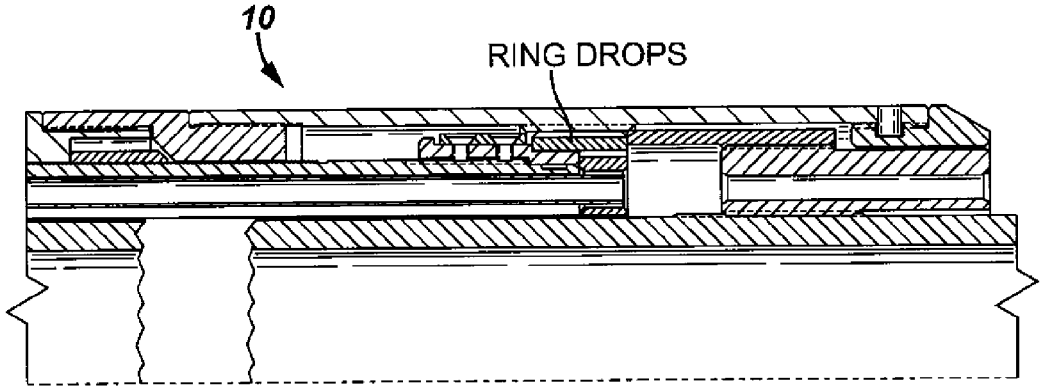
FIG. 4 shows a schematic view of an alternate embodiment of a force transfer apparatus constructed in accordance with the present invention, with the apparatus shown in an initial configuration.
Figure 5:
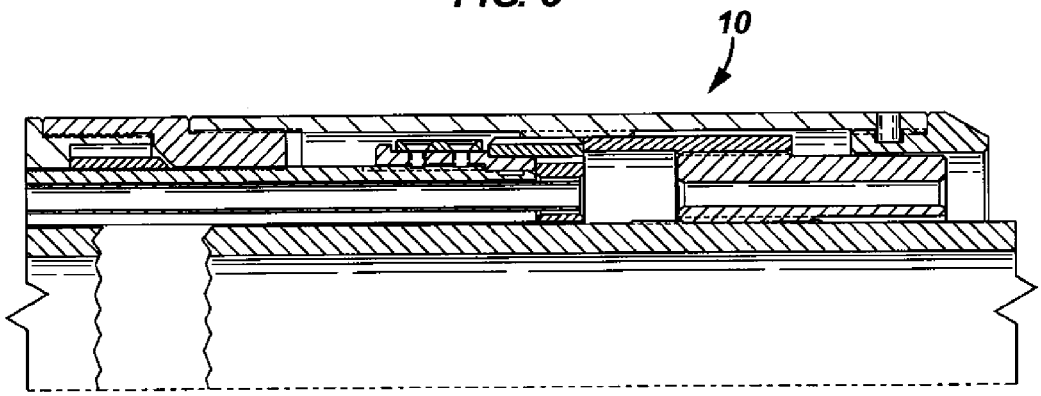
FIG. 5 shows a schematic view of the force transfer apparatus of FIG. 4 in an intermediate configuration.
Figure 6:
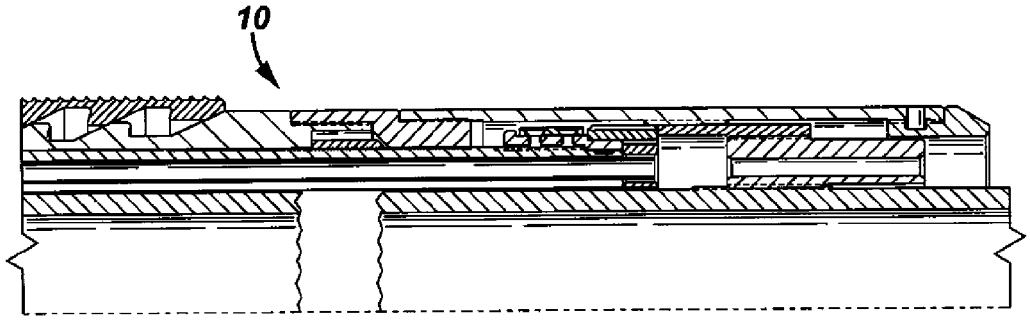
FIG. 6 shows a schematic view of the force transfer apparatus of FIG. 4 in a final configuration.

FIGS. 4, 5, and 6 show an alternate embodiment in which force transfer apparatus 10 is carried near the lower end of the tool. In that embodiment, no transfer ratchet is required.

Figure 8:
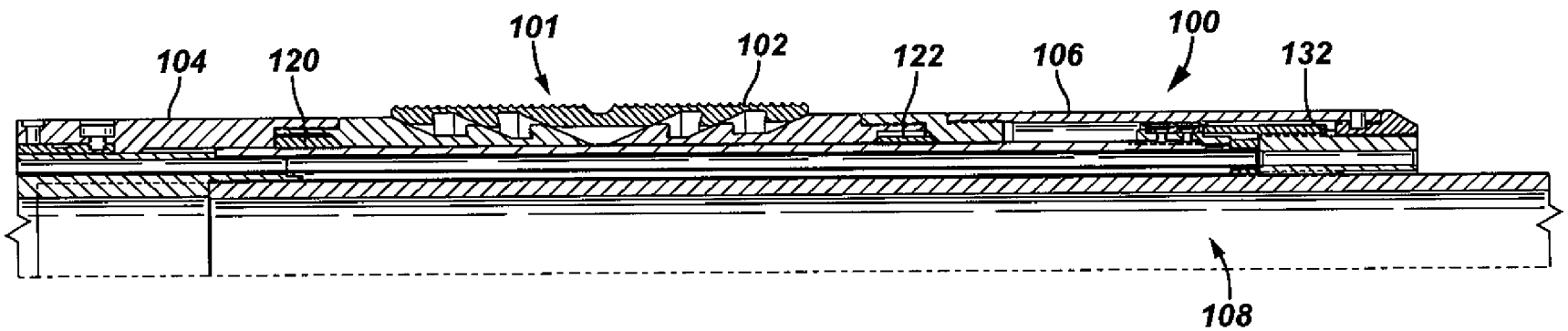
FIG. 8 shows a schematic view of an alternate embodiment of a force transfer apparatus constructed in accordance with the present invention, with the apparatus shown in an initial configuration.

A further embodiment is shown in FIGS. 8-21. FIG. 8 shows a force transfer apparatus 100 with a packer 101 in a "set" position. That is, slip 102 is pushed radially outward by upper cone assembly 104 and lower cone assembly 106 such that slip 102 engages the casing 105 or wellbore wall of the well. Force transfer apparatus 100 and packer 101 are carried on an inner mandrel 108. As described below, inner mandrel 108 will be cut to release packer 101, forming an upper inner mandrel 110 and a lower inner mandrel 112. A middle mandrel assembly 114 lies between inner mandrel 108 and elements of packer 101 and force transfer apparatus 100. Middle mandrel assembly 114 has an upper up-stop 116 that will, upon sufficient travel of middle mandrel assembly 114, abuttingly engage upper cone shoulder 118 on upper cone assembly 104. An upper holding ratchet 120 and a lower holding ratchet 122 are carried on middle mandrel assembly 114 and each has teeth that complementarily mate with teeth on middle mandrel assembly 114 to limit relative motion in one direction.

Force transfer assembly 100 has a lower up-stop 124 that, upon sufficient travel of a load mandrel 126 will abuttingly engage a lower cone shoulder 128 on lower cone assembly 106. Force transfer assembly 100 further comprises a load ring 130 adjacent the upper end of load mandrel 126 and a tension shoulder 132 adjacent the lower end of load mandrel 126.

Figure 9:
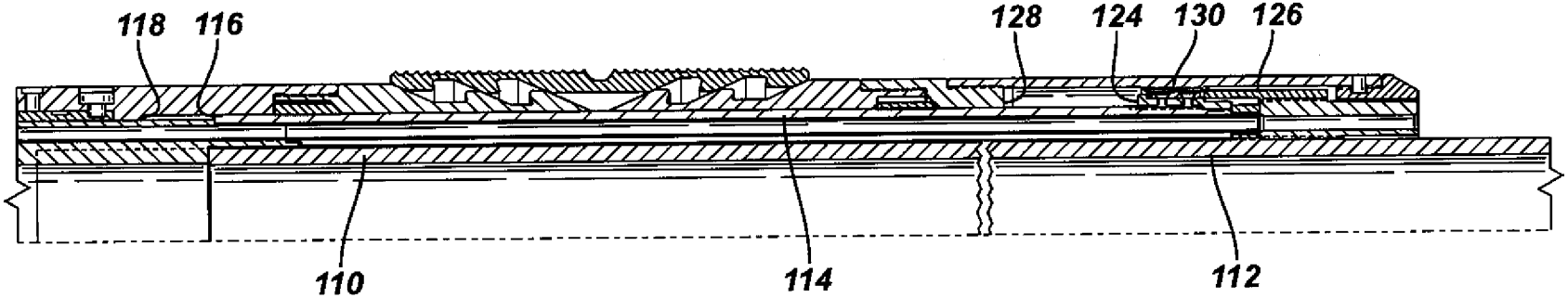
FIG. 9 shows a schematic view of the force transfer apparatus of FIG. 8, with the apparatus shown in a cut-to-release configuration.
Figure 10:
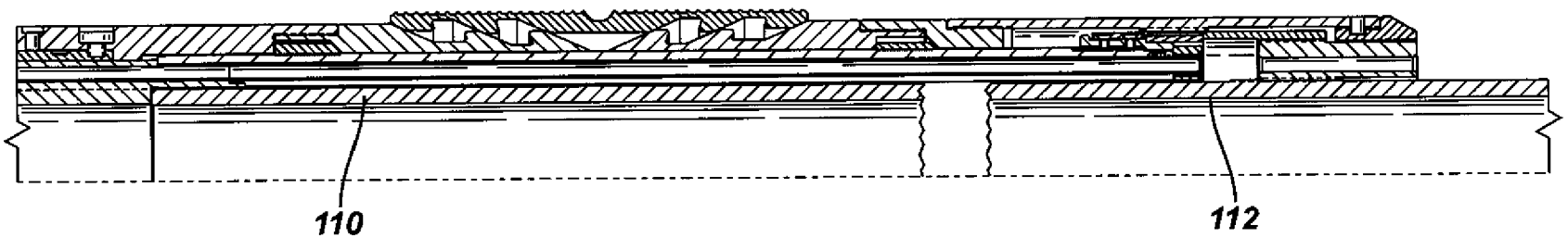
FIG. 10 shows a schematic view of the force transfer apparatus of FIG. 8, with the apparatus shown in a load ring release configuration.

In operation, packer 101 may be released, even if a compressive force from below bears on and passes through packer 101 by severing inner mandrel 108 to form upper inner mandrel 110 and lower inner mandrel 112 (FIG. 9). Upper inner mandrel 110 and middle mandrel assembly 114 are displaced upward by pulling on tubing joined to packer 101 from above, and also in response to the compressive load from below. Middle mandrel assembly 114 slides relative to upper holding ratchet 120 and lower holding ratchet 122. Upon sufficient displacement of middle mandrel assembly 114 (FIG. 10), load ring 130 snaps into a recess 134 (FIG. 18) on the outer diameter of the lower end of middle mandrel assembly 114. Once load ring 130 snaps into place (i.e., into recess 134), threads on the outer diameter of load ring 130 disengage from mating threads on the inner diameter of lower cone assembly 106. At this point, upper cone assembly 104 and lower cone assembly 106 remain in place, but the axial loads therein are relaxed.

Figure 11:
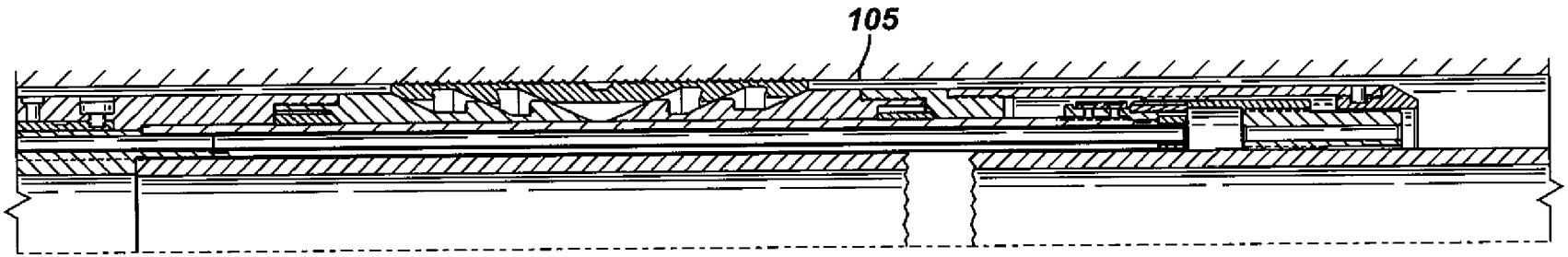
FIG. 11 shows a schematic view of the force transfer apparatus of FIG. 8, with the apparatus shown after an initial upward movement.
Figure 12:
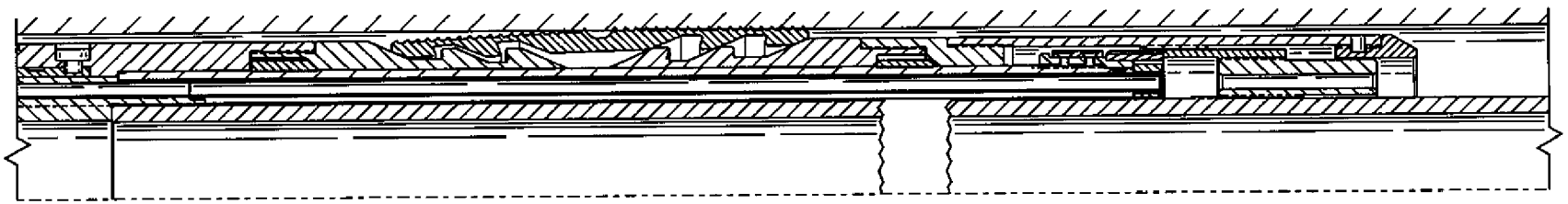
FIG. 12 shows a schematic view of the force transfer apparatus of FIG. 8, with the apparatus shown in an upper cone assembly release configuration.
Figure 13:
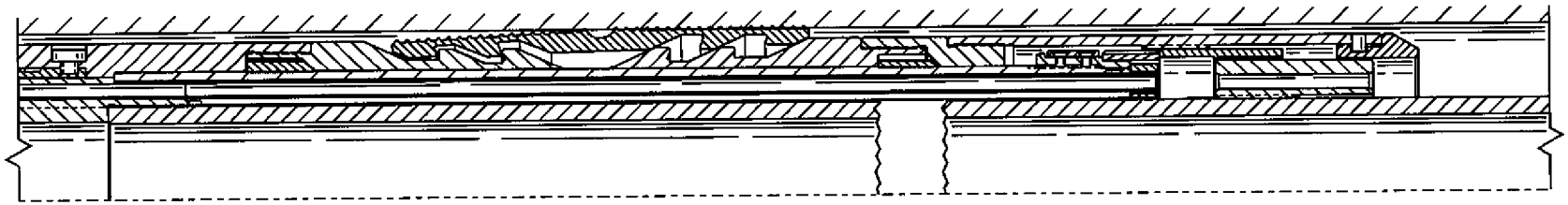
FIG. 13 shows a schematic view of the force transfer apparatus of FIG. 8, with the apparatus shown in an upper cone hook configuration.

Upon sufficient upward travel of middle mandrel assembly 114, upper up-stop 116 bears on upper cone shoulder 118 (FIG. 11). Upper holding ratchet 120 maintains the position of upper cone assembly 104 relative to middle mandrel assembly 114 such that upper cone assembly 104 and middle mandrel assembly 114 move as a unit. Continued upward motion of middle mandrel assembly 114 causes upper cone assembly 104 to move upward relative to slip 102 and unsets the upper portion of slip 102 from casing 105 (FIG. 12). Middle mandrel assembly 114 continues to slide relative to lower holding ratchet 122 during that upward displacement. Further continued upward displacement causes upper cone assembly 104 to "hook" or otherwise engage slip 102 (FIG. 13), pulling slip 102 upward relative to casing 105. Such upward motion may begin to pull slip 102 away from lower cone assembly 106 as well since lower cone assembly 106 is "floating" relative to the load path. At this point, the space between lower up-stop 124 and lower cone shoulder 128 will not allow the load to transfer into slip 102 via lower cone 106.

Figure 14:
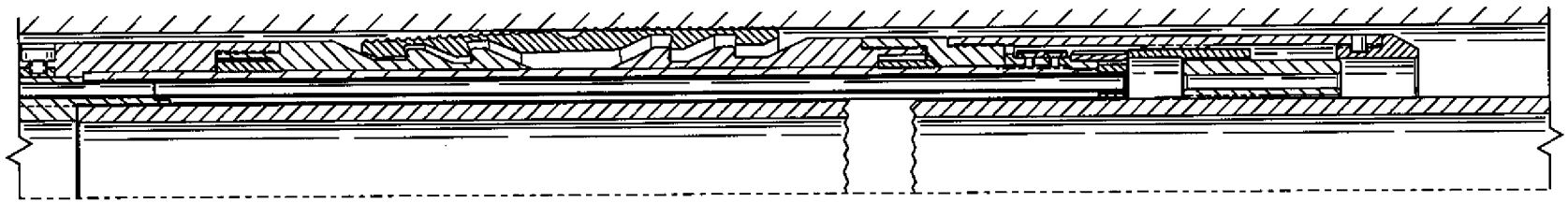
FIG. 14 shows a schematic view of the force transfer apparatus of FIG. 8, with the apparatus shown in a lower cone assembly release configuration.

Should the lower portion of slip 102 not move free from lower cone assembly 106 due to the upward movement of upper cone assembly 104 and middle mandrel assembly 114, slip 102 can be actively disengaged from lower cone assembly 106 by changing the axial movement of middle mandrel assembly 114 to a downward displacement. Such downward movement moves lower cone assembly 106 downward away from slip 102 because lower holding ratchet 122 forces lower cone assembly 106 to move downward with middle mandrel assembly 114. Upper cone assembly 104 also tracks downward because upper holding ratchet 120 keeps upper cone assembly 104 fixed to middle mandrel 114. As lower cone assembly 106 is displaced downward, any trapped axial energy therein is relieved (FIG. 14). Pulling the tubing upwards again hooks slip 102 and upper cone assembly 104 pulls slip 102 free from casing 105. Lower up-stop 124 can only contact lower cone shoulder 128 after it is impossible for slip 102 to be supported by upper and lower cone assemblies 104, 106.

Figure 15:
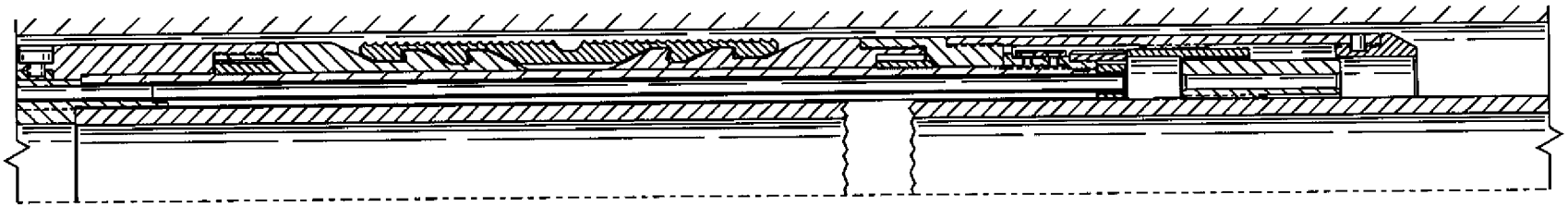
FIG. 15 shows a schematic view of the force transfer apparatus of FIG. 8, with the apparatus shown in a slip retraction configuration.
Figure 16:
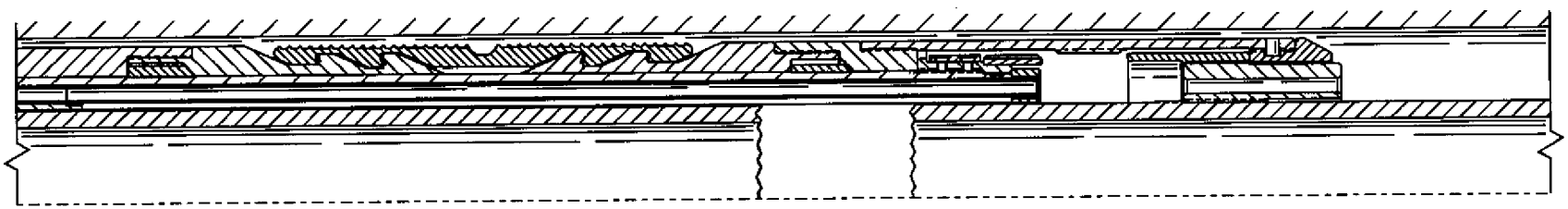
FIG. 16 shows a schematic view of the force transfer apparatus of FIG. 8, with the apparatus shown in an extended position configuration.

As the tubing is pulled upward, the load path never puts slip 102 in tension, but the back angles on upper and lower cone assemblies 104,106 do draw slip 102 radially inward (FIG. 15). The tensile load passing through middle mandrel 114 bypasses the slips and loads lower cone shoulder 128. Upon sufficient upward movement of middle mandrel assembly 114, tension shoulder 132 engages the lower end of load mandrel 126 and carries lower inner mandrel 112 upward along with the rest of the entire lower completion (FIG. 16).

For clarity, FIGS. 17-21 show the various load paths depending on the operational state of force transfer assembly 100. The load paths are indicated by the heavy line passing through the structural elements. The inwardly facing arrowheads indicate compressive loading, while outwardly facing arrowheads indicate tensile loading.

Figure 17:
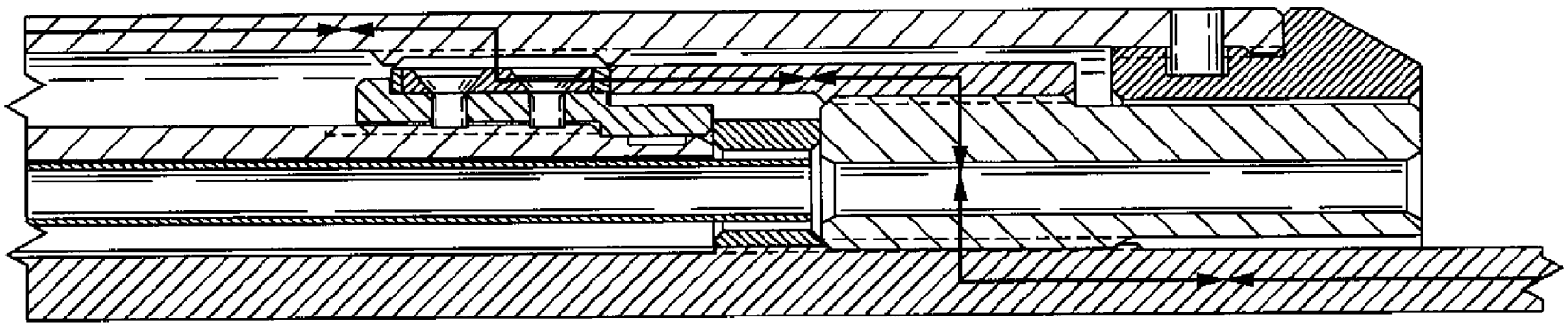
FIG. 17 shows a detailed schematic view of the force transfer apparatus of FIG. 19, with the load path shown.
Figure 19:
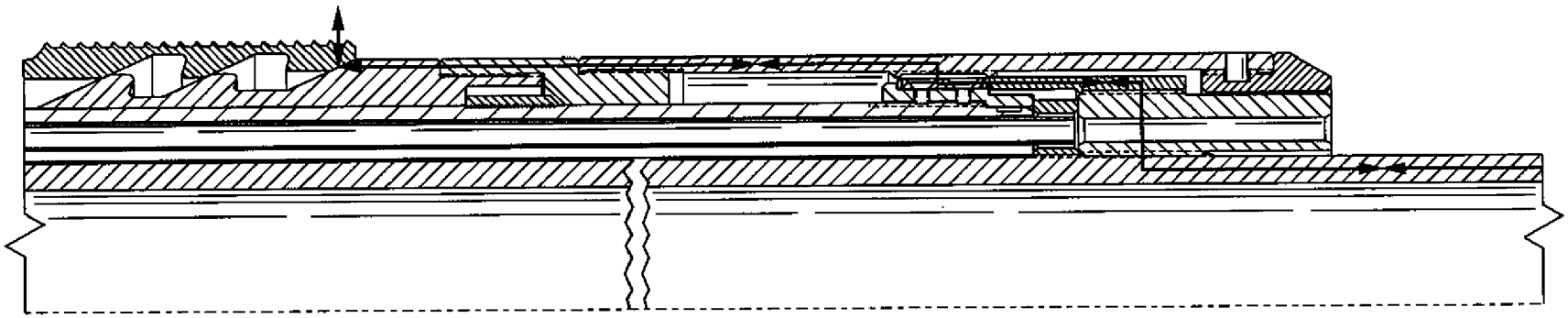
FIG. 19 shows a schematic view of the force transfer apparatus of FIG. 9 (with the load ring engaged with the lower cone assembly), with the load path shown.

FIGS. 17 and 19 show the load path when load ring 130 is engaged with lower cone assembly 106, with FIG. 17 showing a more detailed view of force transfer assembly 100. Following the load from below, it is carried from lower inner mandrel 112 onto load mandrel 126, through load ring 130 into lower cone assembly 106, and through slip 102 into casing 105.

Figure 18:
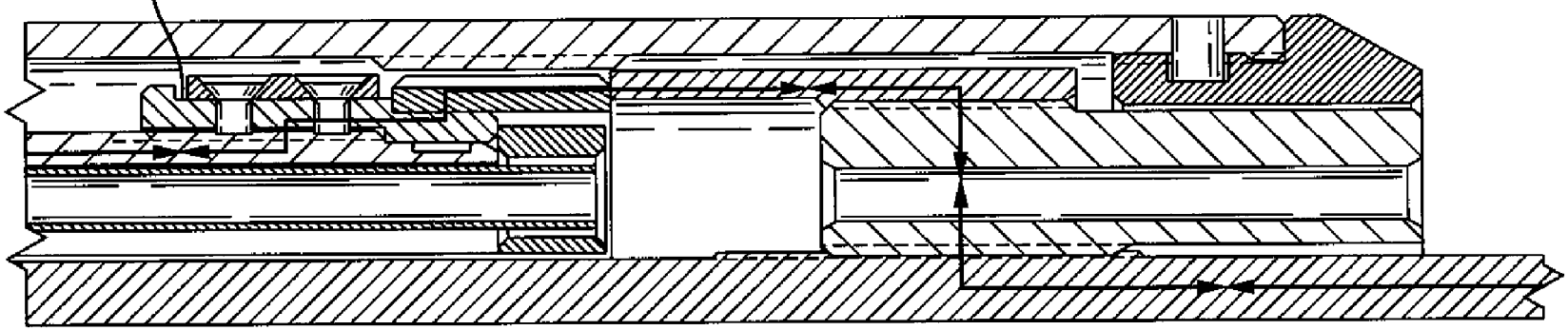
FIG. 18 shows a detailed schematic view of the force transfer apparatus of FIG. 20, with the load path shown.
Figure 20:
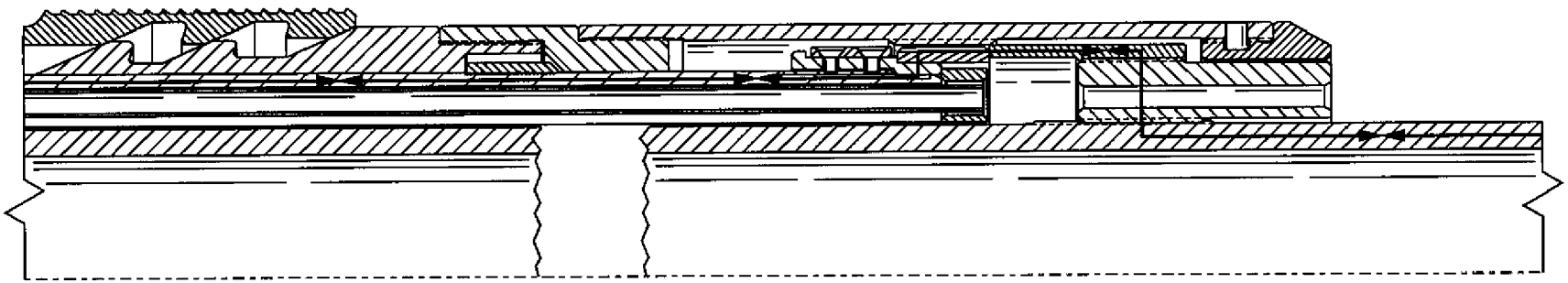
FIG. 20 shows a schematic view of the force transfer apparatus of FIG. 10 (with the load ring disengaged from the lower cone assembly), with the load path shown.

After load ring 130 moves into recess 134, thereby disengaging from lower cone assembly 106, the load path is from lower inner mandrel 112 to load mandrel 126, then into load ring 130 and onto middle mandrel 114 (FIGS. 18 and 20).

Figure 21:
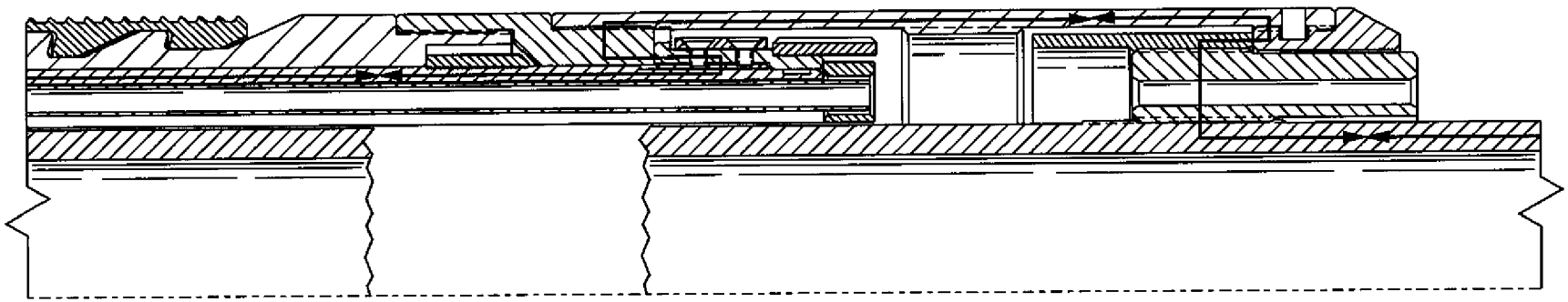
FIG. 21 shows a schematic view of the force transfer apparatus of FIG. 8 (with the completion released), with the load path shown.

FIG. 21 shows the load path once the completion is completely released and ready for retrieval. The tensile load from middle mandrel 114 passes into lower cone assembly 106, into load mandrel 126 via transfer shoulder 132 and on to lower inner mandrel 112.

This invention can be applied to different mechanisms and can be modified or adapted to release with compression from below or tension from above, or vice versa.

Although only a few exemplary embodiments of this invention have been described in detail above, those skilled in the art will readily appreciate that many modifications are possible in the exemplary embodiments without materially departing from the novel teachings and advantages of this invention.

What is claimed is:

1. A force transfer apparatus comprising:

a lower housing assembly;

an inner mandrel assembly adapted to transfer force to the lower housing assembly to move the lower housing assembly to place an element of a downhole tool in a first state, the inner mandrel assembly capable of being severed;

a slip joint located between the lower housing assembly and the element;

a middle mandrel: and a load transfer device adapted to connect the lower housing assembly to the middle mandrel and allow the lower housing assembly to slip with respect to the middle mandrel after the inner mandrel assembly is severed to place in the element in a second state.

2. The force transfer apparatus of claim 1, wherein the inner mandrel assembly creates tension in an upper part of the inner mandrel assembly when the inner mandrel assembly is severed so that the load transfer device is released and a gap is created within the lower housing assembly.

3. The force transfer apparatus of claim 1, wherein the lower housing assembly allows a lower part of the inner mandrel assembly and the lower housing assembly to move upward without engaging a cone and slip assembly.

4. The force transfer apparatus of claim 1, further comprising a transfer ratchet to engage a cone and slip assembly as the inner mandrel assembly and the lower housing assembly moves upward.

5. The force transfer apparatus of claim 1, wherein the load transfer device is adjacent to a cone and slip assembly and the slip joint.

6. The force transfer apparatus of claim 1, wherein the middle mandrel carries a load path from a lower part of the inner mandrel assembly and allows the load path to bypass the slip joint.

7. A method of operating a force transfer apparatus comprising:

using an inner mandrel assembly to transfer force to a lower assembly to move the lower assembly to place an element of a downhole tool in a first state; in response to severing an inner mandrel assembly, releasing a connection between a middle mandrel and the lower assembly and moving the middle mandrel to place the element in the second state, the middle mandrel located radially between the lower assembly and the inner mandrel; and after the element is placed in the second state, engaging the lower assembly with the middle mandrel to retrieve the lower assembly from the well.

8. The method of claim 7,wherein the severing of the inner mandrel assembly creates tension in an upper part of the inner mandrel assembly so that the load transfer device is released and a gap is created within the lower housing assembly.

9. The method of claim 8, wherein the gap allows the lower part of the inner mandrel assembly and the lower housing assembly to move upward without engaging a cone and slip assembly.

10. The method of claim 9, further comprising engaging the cone and slip assembly with a transfer ratchet as the inner mandrel assembly and the lower housing assembly move upwardly.

11. The method of claim 7, wherein the act of using the inner mandrel assembly to transfer force comprises bypassing a slip joint.

12. The method of claim 11 further comprising:

engaging the lower housing assembly and the slip joint.

13. The method of claim 7, wherein the act of using the inner mandrel assembly comprises a cone and slip assembly in tension.

14. A packer device comprising:

a cone and slip assembly;

a lower housing assembly;

an inner mandrel assembly adapted to transfer force to the lower housing assembly to move the lower housing assembly to place the cone and slip assembly in a compressed state, the inner mandrel assembly capable of being severed;

a slip joint located between the lower housing assembly and the cone and slip assembly;

a middle mandrel; and a load transfer device adapted to connect the lower housing assembly to the middle mandrel and allow the lower housing assembly to slip with respect to the middle mandrel after the inner mandrel assembly is severed to place the cone and slip assembly in a relaxed state.

15. The packer device of claim 14 further comprising:

a transfer ratchet assembly which changes a load path from a lower part of the inner mandrel assembly and transfers the load path through a lower part of the lower housing assembly to the middle mandrel.

16. The packer device of claim 14, wherein a lower part of the inner mandrel assembly carries a load path to the middle mandrel and allows the load path to bypass the slip joint.

17. The packer device of claim 14, wherein the inner mandrel assembly is adapted to be severed and creates tension in an upper part of the inner mandrel assembly so that the load transfer device is released and a gap is created within the lower housing assembly.

18. The packer device of claim 14, wherein the lower housing assembly is adapted to allow a lower part of the inner mandrel assembly and the lower housing assembly to move upward without engaging the cone and slip assembly.

19. The packer device of claim 15, wherein the transfer ratchet is adapted to engage the cone and slip assembly as the inner mandrel assembly and the lower housing assembly moves upward.

20. The force transfer apparatus of claim 1, wherein the first state comprises a compressed state of the element, and the second state comprises a relaxed state of the element.

* * * * *